US005937256A

United States Patent [19]

Nakazawa et al.

[11] Patent Number: 5,937,256

[45] Date of Patent: Aug. 10, 1999

[54] FIXING OIL COATING APPARATUS, AND FIXING UNIT THEREWITH

[75] Inventors: Kazuhiro Nakazawa; Takeichi Shimada; Azusa Nakamura; Takahiko Ushiroji, all of Hachioji, Japan

[73] Assignee: Konica Corporation, Tokyo, Japan

[21] Appl. No.: 08/989,972

[22] Filed: Dec. 12, 1997

[30] Foreign Application Priority Data

Dec. 20, 1996 [JP] Japan ..... 8-341259

[51] Int. Cl.[6] ..... G03G 15/20

[52] U.S. Cl. ..... 399/325

[58] Field of Search ..... 355/284; 399/324, 399/325; 118/60; 219/216

[56] References Cited

U.S. PATENT DOCUMENTS

| | | | |
|---|---|---|---|
| 4,136,613 | 1/1979 | Namiki | 118/60 |
| 4,272,666 | 6/1981 | Collin | 399/324 X |
| 4,285,295 | 8/1981 | Iwao et al. | 118/60 |
| 4,512,650 | 4/1985 | Kocher | 399/325 |
| 5,047,809 | 9/1991 | Owada et al. | 399/325 |
| 5,200,786 | 4/1993 | Fromm et al. | 399/325 |
| 5,253,025 | 10/1993 | Mitsuya et al. . | |
| 5,267,004 | 11/1993 | Mills . | |
| 5,285,248 | 2/1994 | Menjo et al. | 219/216 X |
| 5,732,317 | 3/1998 | Orchard, II et al. | 399/325 |
| 5,802,440 | 9/1998 | Maeyama | 399/324 X |

FOREIGN PATENT DOCUMENTS

| | | | |
|---|---|---|---|
| 61-9679 | 1/1986 | Japan | 355/284 |

OTHER PUBLICATIONS

Patent Abstracts of Japan, vol. 018, No. 149 (P–1708) Mar. 11, 1994, of JP 05 323822A Dec. 7, 1993.

Patent Abstracts of Japan, vol. 009, No. 148 (P–366) Jun. 22, 1985 of JP 60 026971A Feb. 9, 1985.

Patent Abstracts of Japan, vol. 008, No. 068 (P–264) Mar. 30, 1984 of JP 58 215675A, Dec. 15, 1983.

*Primary Examiner*—S. Lee

*Attorney, Agent, or Firm*—Frishauf, Holtz, Goodman, Langer & Chick, P.C.

[57] ABSTRACT

In a fixing oil coating apparatus for coating oil to an outer circumferential surface of a fixing roller for fixing a toner image of a recording sheet, the apparatus has an oil coating roller including a cylindrical porous member impregnated with oil therein, and a brush-shaped oil applying member fixed on an outer circumferential surface of the porous member. The brush-shaped oil applying member is brought into contact with the outer circumferential surface of the fixing roller so that the oil is coated to the fixing roller.

6 Claims, 6 Drawing Sheets

FIXING OIL COATING APPARATUS, AND FIXING UNIT THEREWITH

BACKGROUND OF THE INVENTION

The present invention relates to a fixing oil coating apparatus and more specifically to a fixing oil coating apparatus to coat oil on an outer circumferential surface of a fixing roller in order to fix a toner image on a supporting material such as a recording sheet and the like.

Conventionally, as an oil coating roller employed in the fixing oil coating apparatus, as shown in FIG. 7, there has been disclosed an apparatus having a structure in that a hollow pipe-shaped metal core 101 is wound with felt cloth 100; in the inner hollow portion of the above-mentioned core 101, oil 102 is stored and the oil is supplied to the above-mentioned felt cloth through a plurality of holes 103 formed by penetrating the circumferential wall of the above-mentioned core 101 (refer to Japanese Utility Model Publication Open to Public Inspection 59-73762, etc.).

Further, in FIG. 7, the reference numeral 104 shows a rotation axis of an oil coating roller and the reference numeral 105 shows a fixing roller on which the oil is coated by the above-mentioned oil coating roller.

However, in the above-mentioned conventional oil coating roller, a problem has been caused in that when the toner adheres to a felt cloth 100 as an oil coating member, it is readily clogged and the oil cannot be consistently coated on the fixing roller 105 for a long time of period.

Furthermore, in the construction in that the oil 102 stored in the hollow portion of the core 101 is supplied to the felt cloth 100 through the holes 103, there has been a possibility such that it is difficult to supply uniformly the oil to the felt cloth 100 and the oil is not uniformly coated on the fixing roller 105.

In the coating roller employing a ceramic member, there has been a problem in that because the oil is supplied to all the region in the axial direction of the ceramic member, oil drips are caused in the portion (out of the maximum sheet width) where no sheet is passed.

Namely, in the oil coating roller, in the region (sheet passing portion) where a sheet is passed, oil consumption and oil coating are repeated. However, in the region (no sheet passing portion) where a sheet is not passed, the oil coating is repeated without consuming the oil and the oil is accumulated. When the oil accumulated state is left for many hours, the oil accumulated in the no sheet passing region moves to the sheet passing portion. As a result, when started again, the oil drips are caused in the sheet passing portion and the sheet is liable to be stained by oil spots.

SUMMARY OF THE INVENTION

In view of the foregoing, the present invention has been accomplished and can prevent the clogging of the oil coating member and provides a fixing oil coating apparatus which can coat uniformly oil on a fixing roller.

Another object of the present invention is to provide a fixing oil coating apparatus which can uniformly supply oil to an oil coating member such as felt, brush, etc. and can prevent oil drips in a sheet passing portion.

The fixing oil coating apparatus of the present invention is a fixing oil coating apparatus to coat oil on the outer circumferential surface of a fixing roller to fix a toner image on a support material and is constructed in such a way that the construction of an oil coating roller is that the oil is impregnated and held in a cylindrical ceramic member having a number of exceedingly small pores, and an oil coating member comprising a brush is fixed to an outer circumference of the above-mentioned ceramic member and the oil is coated on the outer circumferential surface of the above-mentioned fixing roller, while the oil coating member of the oil coating roller is brought into contact with the above-mentioned fixing roller.

Furthermore, in the present invention, the construction is that a regulating sheet is arranged between the above-mentioned ceramic member and oil coating member in order to regulate a supply of the oil from the above-mentioned ceramic member to the above-mentioned oil coating member.

Furthermore, in the present invention, the structure is that a scraper is provided to scrape off the toner adhered to the tip portion of the brush of the above-mentioned oil coating member.

Furthermore, in the present invention, the construction is that the oil is supplied to the above-mentioned scraper.

Furthermore, in the present invention, the above-mentioned scraper is composed of an oil holding pad impregnated with the oil.

DETAILED DESCRIPTION OF THE PREFERRED EMBODIMENT

In the following, the embodiments of the present invention are explained.

Figure 1:
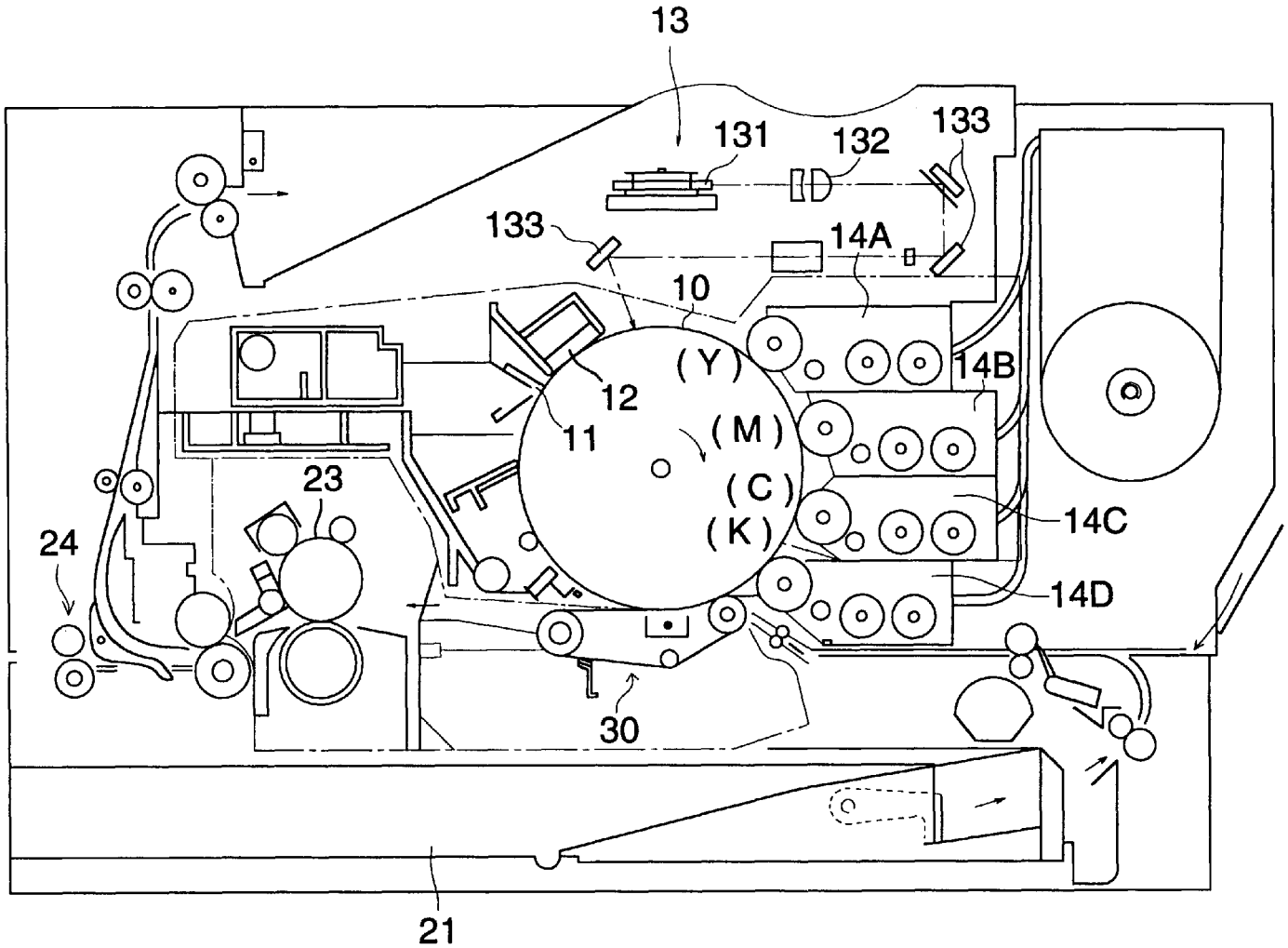
FIG. 1 is a general schematic diagram showing a construction of a laser color printer to which the fixing oil coating apparatus according to the present invention is applied.

FIG. 1 shows a construction of a laser color printer constructed employing a fixing device provided with the fixing oil coating apparatus according to the present invention. However, the printer constructed employing the fixing device is not limited to neither a laser type nor color.

In the above-mentioned FIG. 1, a photoreceptor drum 10 whose surface is coated with an OPC photosensitive layer is rotationally driven in one direction (in FIG. 1, clockwise direction), and after the charge is removed using charge elimination by a PCL (pre-charging) 11, the circumferential surface is uniformly charged by a charging device 12.

After the above-mentioned uniform charging, an image exposure is performed by an image exposing means 13 according to an image signal. In the image exposing means 13, a laser beam emitted from a laser source, not shown, is rotationally scanned by a polygon mirror 131; is led through a fθ lens 132; is turned by a reflection mirror 133; is projected onto the circumferential surface of the photoreceptor drum 10 uniformly charged in advance and a latent image is formed on the surface of the photoreceptor drum 10.

Around the periphery of the photoreceptor drum 10, are provided developing devices 14A to 14D which are loaded with each of developers composed of mixtures of each of yellow (Y), magenta (M), cyan (C) and black (K) toners with a carrier. And at first, the development of the first color (yellow Y) is carried out; after the development of the first color is finished, an image forming process of the second color (magenta M) is commenced; the photoreceptor 10 is uniformly charged again and a latent image is formed by the image exposing means 13 according to the image data of the second color. As to the third color (cyan C) and fourth color (black K), the similar image forming processes are carried out and the development of all the four colors are carried out on the circumferential surface of the photoreceptor drum 10.

On the other hand, a recording sheet P (supporting material) transported by a sheet transport mechanism 22 from a sheet cassette 21 is advanced to a transfer device 30, wherein the multicolor toner images on the circumferential surface of the photoreceptor drum 10 is simultaneously transferred to the recording sheet P.

After the transfer at the transfer device 30, the recording sheet is conveyed to a fixing device 23 composed of two rollers, upper and lower having a heater in the interior of at least one of rollers; the toners on the recording sheet P are fused and fixed between the fixing rollers by the application of heat and pressure and the recording sheet subjected to fixing is ejected from the apparatus by an sheet ejecting mechanism 24.

Figure 2:
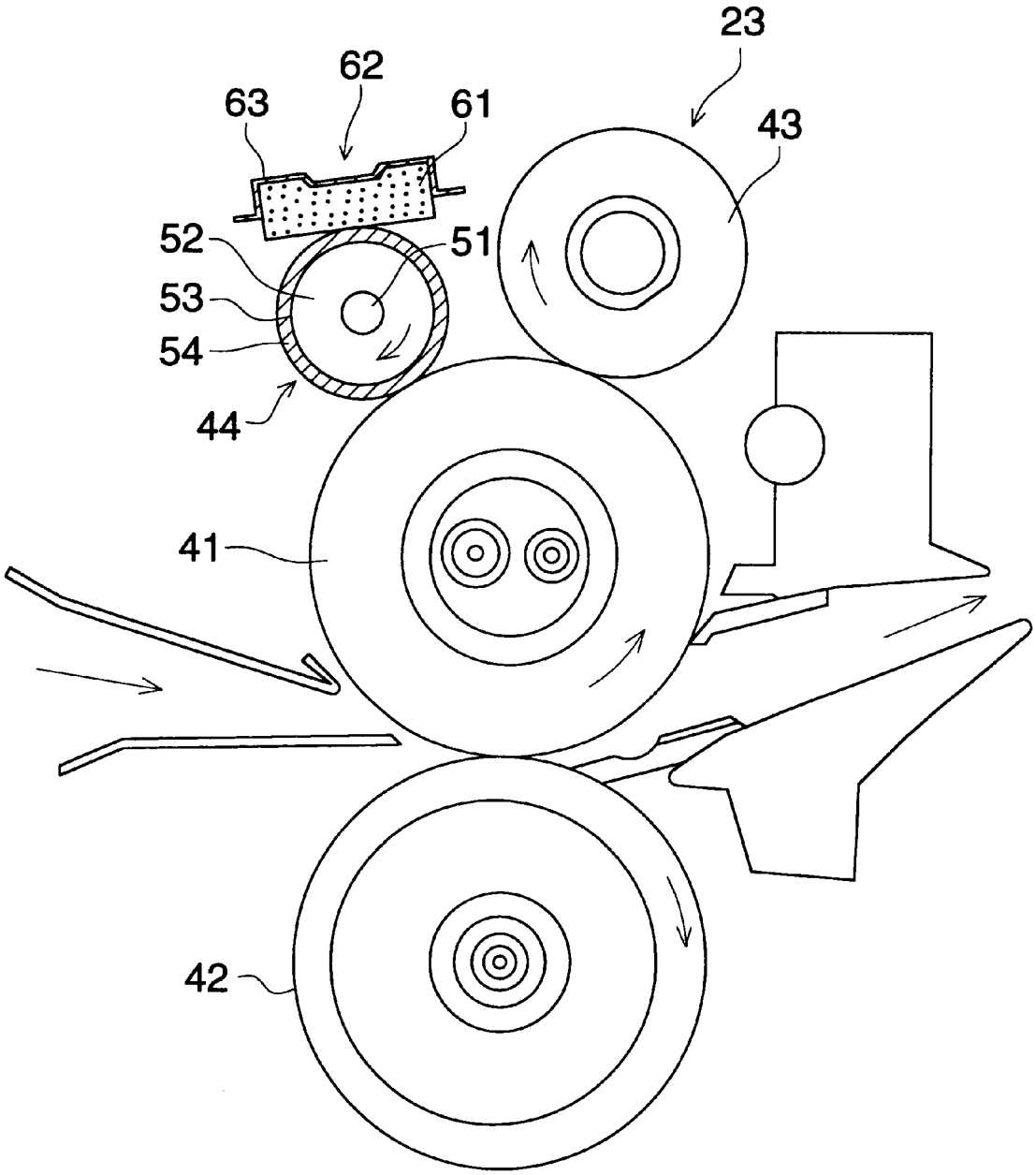
FIG. 2 is a schematic diagram showing an embodiment of the fixing oil coating apparatus according to the present invention.

FIG. 2 shows details of the construction of the above-mentioned fixing device 23. The construction is that after the transfer, the recording sheet P is transported from the left side in the figure against the upper and lower rollers 41 and 42. Heat and pressure is applied to the recording sheet P between the above-mentioned fixing rollers 41 and 42, and the toner is fixed and the recording sheet P is successively conveyed from the left side to the right side in the drawing.

The above-mentioned upper fixing roller 41 is constructed so that it is rotationally driven counter clockwise by a motor, not shown, and for example, it is prepared by applying Teflon treatment to a cylindrical metal surface and has a heater for heating in the interior. On the other hand, the above-mentioned lower roller 42 is prepared, for example, by winding silicone rubber on a metal core and is brought into pressure contact with the above-mentioned upper fixing roller 41 and is driven clockwise in the drawing according to the rotation of the upper fixing roller 41.

Furthermore, the construction is that a cleaning roller 43 and an oil coating roller 44 are additionally arranged to the above-mentioned upper fixing roller 41; the outer circumferential surface of the upper fixing roller 41 which has passed a nip portion (pressure contact portion) of the two fixing rollers 41 and 42 is, at first, subjected to removal of offset toner (toner adhered to the upper fixing roller 41, which is not fixed on a recording sheet P) by pressure contact with the above-mentioned cleaning roller 43; after the cleaning, oil is coated by contact with the above-mentioned oil coating roller 44 and is again led to the nip portion.

The outer circumferential surface of the above-mentioned cleaning roller 43 is formed by silicone foam and the offset toner adhered to the above-mentioned upper fixing roller 41 is captured by the above-mentioned silicone foam and the offset toner is removed from the fixing roller 41.

Figure 3:
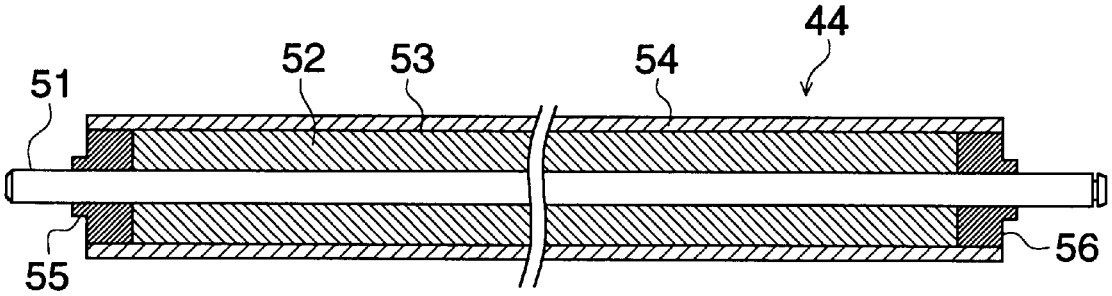
FIG. 3 is a sectional view of an oil coating roller in the above-mentioned embodiment.

As shown in FIGS. 2 and 3, the above-mentioned oil coating roller 44 is composed of the cylindrical ceramic member 52 having a number of exceedingly small pores to which a metal rotation shaft 51 is inserted, a regulating paper 53 composed of nonwoven fabric, etc. wound on the outer circumference of the ceramic member 52 and a brush-shaped oil coating member 54 which is wound on the outer circumference of the above-mentioned regulating sheet 53, and at both the ends in the axial direction of the above-mentioned ceramic member 52, metal flanges 55 and 56 are attached.

And the above-mentioned fixing roller 41 is brought into pressure contact with the oil coating member 54 of the above-mentioned oil coating roller 44 and the oil coating roller 44 is driven by the rotation of the fixing roller 41 so that the oil coating roller is frictionally rotated at the same circumferential speed. Further, the oil coating roller 44 may be rotationally driven at the same or less circumferential speed as that of the fixing roller 41, while being subjected to rotational driving force of the motor which rotationally drives the fixing roller 41 through a gear, etc. which are provided coaxially with the above-mentioned oil coating roller 44.

The above-mentioned ceramic member 52 is impregnated with oil (silicone oil) and functions as an oil holding layer for coating the oil on the above-mentioned upper fixing roller 41. And the oil impregnated in the above-mentioned ceramic member 52 is adjusted by the above-mentioned regulating paper 53, is supplied to the above-mentioned brush-shaped oil coating member 54 and is coated on the above-mentioned upper fixing roller 41 from the tip portion of the brush of the oil coating member 54.

The above-mentioned brush-shaped oil coating member 54 is such that, for example, a brush having a length of 2 to 3 mm is planted on a base for fixing the brush.

Further, the above-mentioned regulating paper 53 is adhered to the above-mentioned ceramic member 52 and the above-mentioned brush-shaped oil coating member 54 is adhered and fixed to the above-mentioned regulating paper 53. However, because the above-mentioned adhered portion becomes an oil sealing portion, non-uniform supply of the oil is prevented, for example, by coating an adhesive in a spiral pattern and the like.

When constructed as mentioned above in that the oil is coated on the fixing roller 41 by the oil coating roller 44, the oil is impregnated and held in the ceramic member 52 having a number of exceedingly small pores. As a result, the oil can be supplied almost uniformly to the oil coating member 54 from the whole circumference of the ceramic member 52. Thus, the oil can be uniformly coated on the fixing roller 41. Furthermore, because the oil coating member 54 is shaped as a brush-like, clogging is hardly caused even if the offset toner is adhered, and the oil can be consistently coated on the fixing roller 41.

As mentioned above, the degradation in coating properties due to the offset toner can be avoided by rendering the oil coating member 54 brush-like. However, when the adhesion of the offset toner increases, the adhered offset toner 71 adheres in a mat shape to the tip potion of the brush to likely cause a problem in the oil coating. Thus, a scraper is preferably provided which scrapes the offset toner adhered to the tips of the brush of the oil coating member 54.

Figure 4:
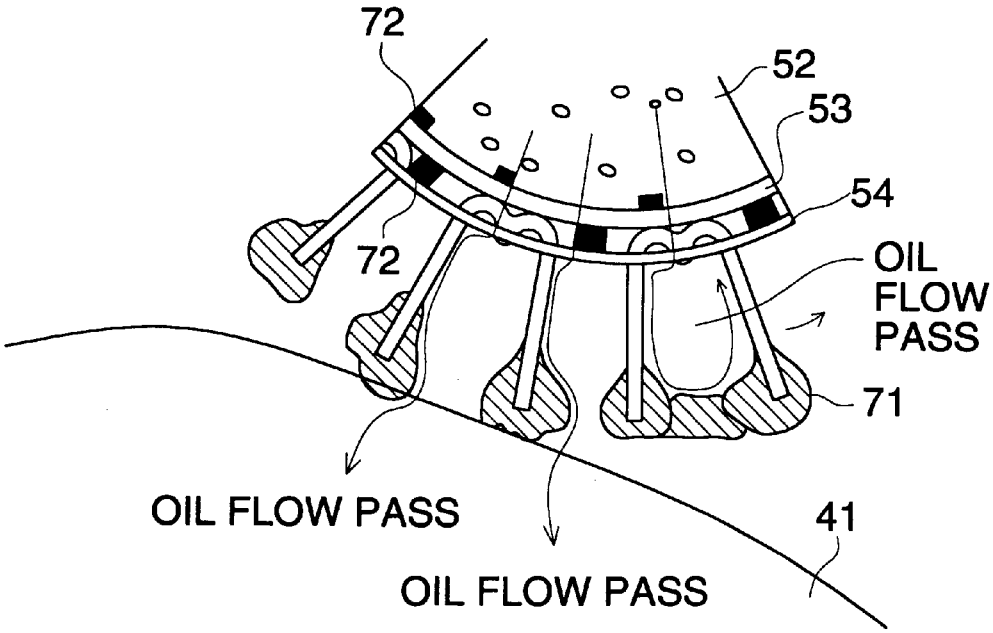
FIG. 4 is a state diagram showing the relationship between an adhered toner and a oil pass in the above-mentioned embodiment.

Further, in FIG. 4, the reference numeral 72 represents the adhered position.

In the present embodiment, as the above-mentioned scraper, an oil holding pad 62 in which a heat resistant felt 61 is impregnated with the oil is provided at the position where it is brought into contact with the brush of the above-mentioned oil coating member 54 while supported by a bracket 63.

As the above-mentioned scraper, a plate made of resin may be employed. Even in the case of employing the above, a construction in that as the scraper, the oil stored in a tank is supplied to the resin plate can decrease remarkably the amount of the toner adhered to the tips of the brush.

However, instead of constructing the scraper in which the oil is supplied to the resin plate, when constructed by employing the oil holding pad as described above, it is preferable that the scraper is conveniently constructed which can remarkably decrease the adhesion amount of the toner.

According to the present invention, the construction in that oil is impregnated and held in the cylindrical ceramic member having a number of exceedingly small pores makes it possible to supply uniformly the oil to the oil coating member and employing a member shaped like a brush as the above-mentioned oil coating member exhibits an advantage in the prevention of clogging of the oil coating member caused by the toner.

Furthermore, the amount of the oil supplied to the oil coating member is adjusted to an optimum amount by the regulating paper arranged between the ceramic member and the oil coating member and an advantage is exhibited in that the above-mentioned supply amount and further excessive and deficient oil amount adhered to the fixing roller can be prevented.

Furthermore, because the toner adhered to the tip portion of the brush of the brush-shaped oil coating member is scraped off by the scraper, an advantage is exhibited in that the degradation of the oil coating properties to the fixing roller due to the above-mentioned adhered toner is prevented.

Furthermore, an advantage is exhibited in that supplying the oil to the scraper makes it possible to decrease remarkably the amount of toner adhered to the tips of the brush of the oil coating member.

Furthermore, the scraper which makes it possible to decrease remarkably the amount of toner adhered to the tips of the brush of the oil coating member is readily constructed without employing an oil tank, etc.

In FIG. 3, the above-mentioned ceramic member 52 has exceedingly small pores, as mentioned above, and the exceedingly small pores formed almost evenly around the whole circumference are capable of supplying almost uniformly the oil to the whole region in the axial direction of the oil coating member 54. In the present embodiment, the construction is that the circumferential surfaces of both ends in the axial direction of the above-mentioned ceramic member 52 undergo sealing and the length in the axial direction of the non-sealing portion of the above-mentioned ceramic member 52 is equal to the maximum sheet passing width or less.

Figure 5:
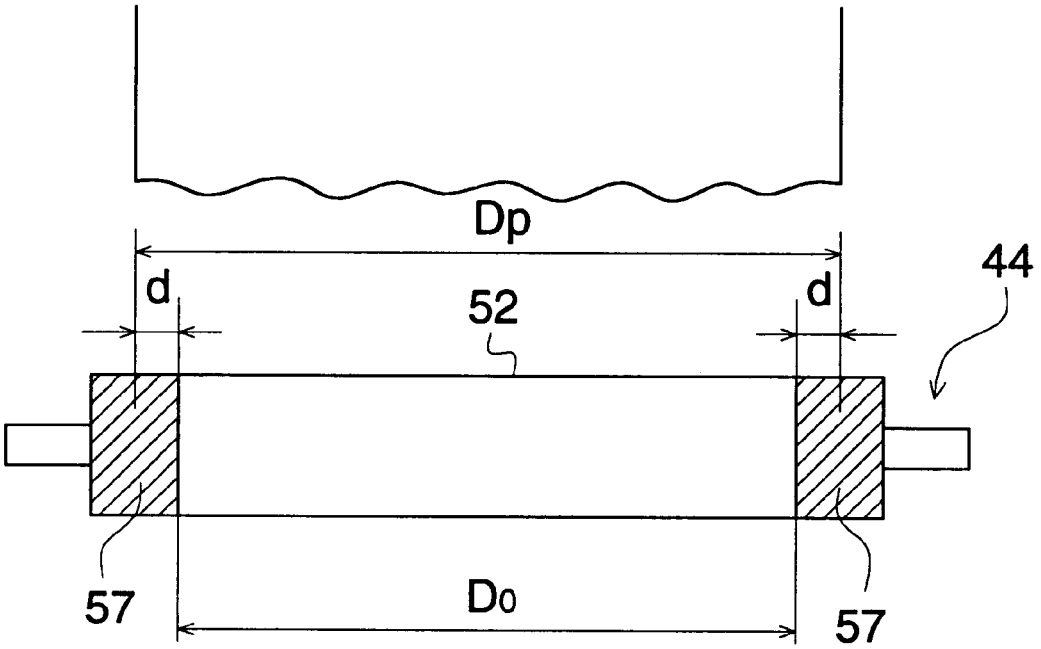
FIG. 5 is a front view showing a sealing portion of the oil coating roller in the above-mentioned embodiment.

Specifically, as shown in FIG. 5, an adhesive (for example, Si series adhesives) is coated so that the axial direction length $D_0$ of the above-mentioned non-sealing portion is equal to the maximum sheet passing width $D_P$ or less.

In such the construction, the adhesive coating layer 57 arranged between the above-mentioned ceramic member 52 and oil coating member 54 intercepts the oil supplying route from the above-mentioned ceramic member to the oil coating member and the direct oil supply to the non-sheet passing portion can be prevented. Thus, it is possible to prevent the oil spot which is formed in such a way that the oil is supplied to the no sheet passing portion where no oil is consumed and accumulated; the accumulated oil moves to the sheet passing portion and the oil spot remains on a recording sheet.

The boundary of the above-mentioned sealing layer 57 may be accorded with both the ends of the maximum sheet passing width $D_P$. The oil supplied to the oil coating member 54 from the ceramic member 52 is penetrated to a portion where no oil is directly supplied from the ceramic member 52. Thus, it is possible to perform optimum oil coating for the maximum sheet passing width $D_P$, even though the above-mentioned sealing boundary is positioned in the inside of both the ends of the above-mentioned maximum sheet passing width $D_P$. However, when a distance d between both the ends of the maximum sheet passing width $D_P$ and the above-mentioned sealing boundary is excessively large, an amount of oil coating becomes insufficient near both ends of the maximum sheet passing width $D_P$. Therefore, the above-mentioned distance d is preferably adjusted in the range of $0 \leqq d \leqq 10$ mm.

Furthermore, as mentioned above, in the present embodiment, a construction is that a driving force of a motor which rotationally drives the above-mentioned fixing roller 41 is transmitted to the above-mentioned oil coating roller 44 through a driving gear and the above-mentioned oil coating roller 44 is rotationally driven at a less circumferential speed than that of the fixing roller 41.

In the case of a construction in which the oil is coated on the fixing roller 41 by the oil coating roller 44, a construction may be employed in that the oil coating roller 44 is driven by the rotation of the fixing roller 41 employing the frictional force at the pressure contact portion of the fixing roller 41 with the oil coating roller 44. However, in such the construction, a portion of the oil coating member 54 is collectively stained with the toner on account of the slip of the oil coating roller 44 and defects are caused on an image by spewing the adhered toner (phenomenon in which the toner adhered on the oil coating roller 44 is again adhered by the fixing roller 41), etc.

Figure 6:
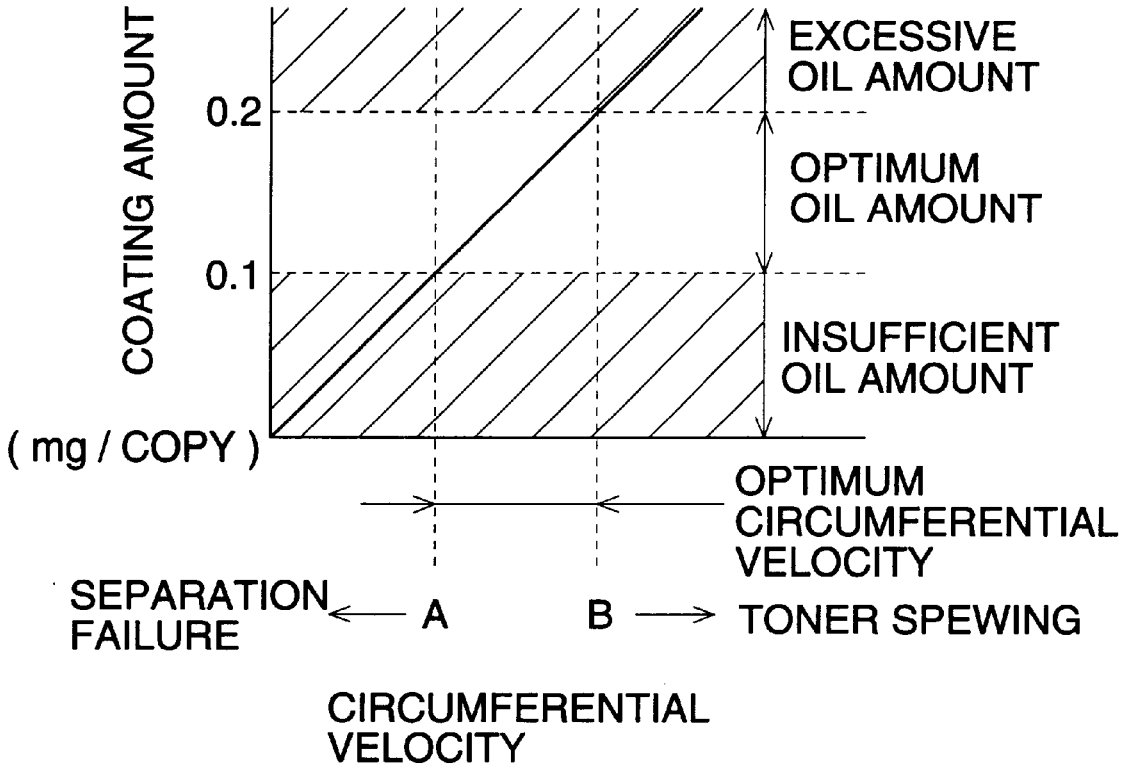
FIG. 6 is a graph of an optimum circumferential velocity of an oil coating roller.
Figure 7:
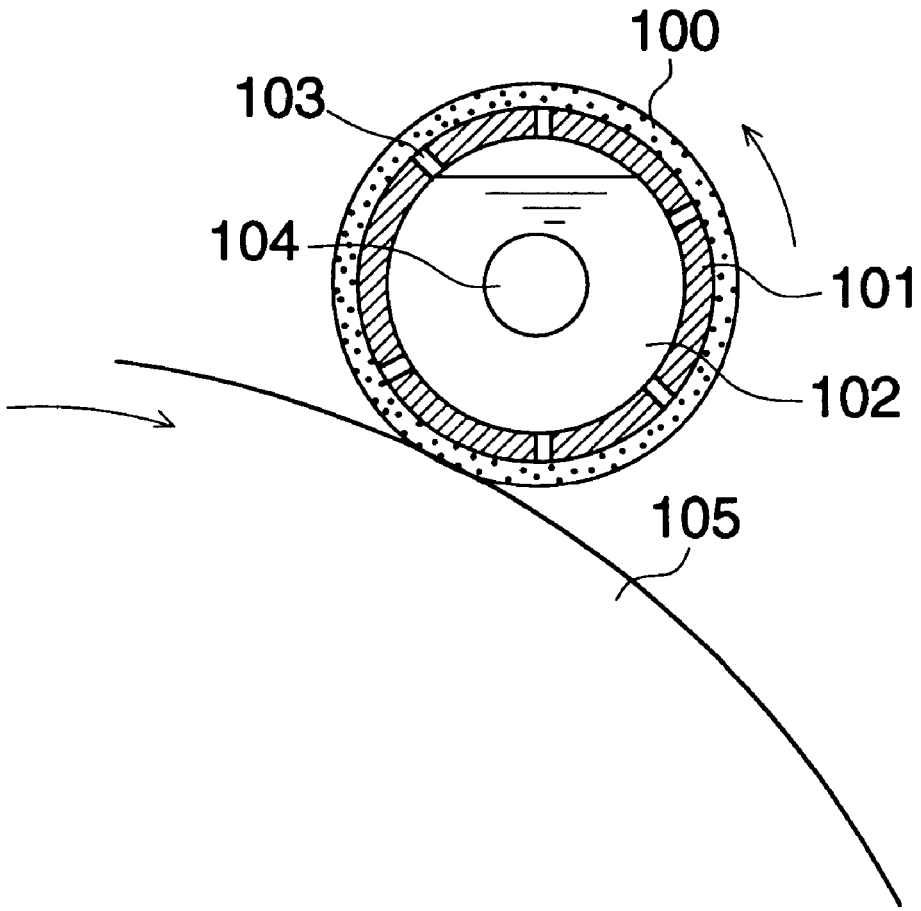
FIG. 7 PRIOR ART
FIG. 7 is a fragmentary sectional view of a conventional oil coating roller.

On the contrary, when the oil coating roller 44 is constructed so as to be rotationally driven, the above-mentioned slip can be prevented and staining collectively a portion of the oil coating member 54 with the toner can be avoided. Furthermore, the above-mentioned toner spewing tends to increase as the oil coating amount increases. Therefore, it is possible to avoid more effectively the above-mentioned toner spewing by decreasing the circumferential speed of the oil coating roller 44. However, when the circumferential speed is decreased excessively, the coating amount of oil becomes insufficient to degrade the degree of the recording sheet separation. Therefore, it is required to set the circumferential speed of the oil coating roller 44 at faster than the speed to secure the necessary oil coating amount (refer to FIG. 6.).

According to the present invention, the advantage is that the generation of oil drips on the oil coating member corresponding to the no sheet passing portion can be prevented by the sealing.

Furthermore, the advantage is that by performing the sealing so that the sealing boundary is positioned in an inside of 0 to 10 mm from each of both the ends of the maximum sheet passing width, the oil can be securely coated on the fixing roller within the sheet passing width, while avoiding the formation of oil drips.

Furthermore, the advantage is that the sealing for the ceramic member is conveniently performed by adhesive coating.

Furthermore, the advantage is that by being rotationally driven so that the circumferential speed of the oil coating roller is less than that of the fixing roller, no degradation of oil coating properties occurs due to the slip of the oil coating roller against the fixing roller and a necessary amount of oil can be coated on the whole circumferential surface of the fixing roller.

What is claimed is:

1. A fixing oil coating apparatus which coats oil to a fixing member, comprising:

(a) an oil coating roller including a cylindrical porous member impregnated with oil therein, and an oil applying member fixed on an outer circumferential surface of the cylindrical porous member, wherein the oil applying member comprises a brush member which is brought into contact with an outer circumferential surface of the fixing member; and (b) a scraper for scraping off toner adhered on tip ends of the brush member.

2. The fixing oil coating apparatus of claim 1, wherein the oil coating roller further comprises a regulating sheet provided between the porous member and the oil applying member for regulating a supplying amount of the oil from the porous member to the oil applying member.

3. The fixing oil coating apparatus of claim 1, wherein the oil is supplied to the scraper.

4. The fixing oil coating apparatus of claim 1, wherein the scraper includes an oil holding pad impregnated with the oil.

5. The fixing oil coating apparatus of claim 1, wherein the porous member is made of ceramic.

6. A fixing unit comprising:

(a) a pair of fixing rollers which comprise a heat roller and a pressing roller;

(b) an oil coating roller including a cylindrical porous member impregnated with oil therein, and an oil applying member fixed on an outer circumferential surface of the cylindrical porous member, wherein the oil applying member comprises a brush member which is brought into contact with an outer circumferential surface of the heat roller; and (c) a scraper for scraping off toner adhered on tip ends of the brush member.

* * * * *